US005509564A

United States Patent [19]

Knoop

[11] Patent Number: 5,509,564

[45] Date of Patent: Apr. 23, 1996

[54] VENTING DEVICE

[75] Inventor: Robert D. Knoop, Beatrice, Nebr.

[73] Assignee: Custom Metalcraft, Inc., Springfield, Mo.

[21] Appl. No.: 186,063

[22] Filed: Jan. 25, 1994

[51] Int. Cl.[6] ..... B65D 51/16

[52] U.S. Cl. ..... 220/360; 220/361; 220/366.1; 220/367.1

[58] Field of Search ..... 720/353, 367.1, 720/366.1, 360, 361

[56] References Cited

U.S. PATENT DOCUMENTS

| | | | |
|---|---|---|---|
| 169,150 | 10/1875 | Cornish . | |
| 354,859 | 12/1886 | Gillette . | |
| 599,300 | 2/1898 | Mohn . | |
| 2,468,340 | 4/1949 | Mirassou . | |
| 2,816,681 | 12/1957 | Taylor . | |
| 2,840,105 | 6/1958 | Routledge . | |
| 3,184,091 | 5/1965 | Hoffman . | |
| 3,343,710 | 9/1967 | Wehle et al. . | |
| 3,760,977 | 9/1973 | MacKinnon . | |
| 4,026,512 | 5/1977 | Holt . | |
| 4,307,820 | 12/1981 | Binoche | 220/367 |
| 4,441,622 | 4/1984 | Von Holdt . | |

FOREIGN PATENT DOCUMENTS

| | | | |
|---|---|---|---|
| 0325898 | 10/1988 | European Pat. Off. . | |
| 1336795 | 2/1972 | United Kingdom | 220/367 |
| 197809 | 12/1974 | United Kingdom | 220/367 |

*Primary Examiner*—Joseph M. Moy
*Attorney, Agent, or Firm*—Nies, Kurz, Bergert & Tamburro

[57] ABSTRACT

A bung plug venting device having a threaded slot configuration for use such as in relieving internal pressure in a container for liquids is disclosed. In one embodiment, a plurality of slots are spaced at equal intervals around the threaded neck portion of the bung plug, with the upper end of the slots being positioned below the upper threads of the neck portion. The number and width of the slots will depend on the capacity of the container.

10 Claims, 2 Drawing Sheets

FIG. 1
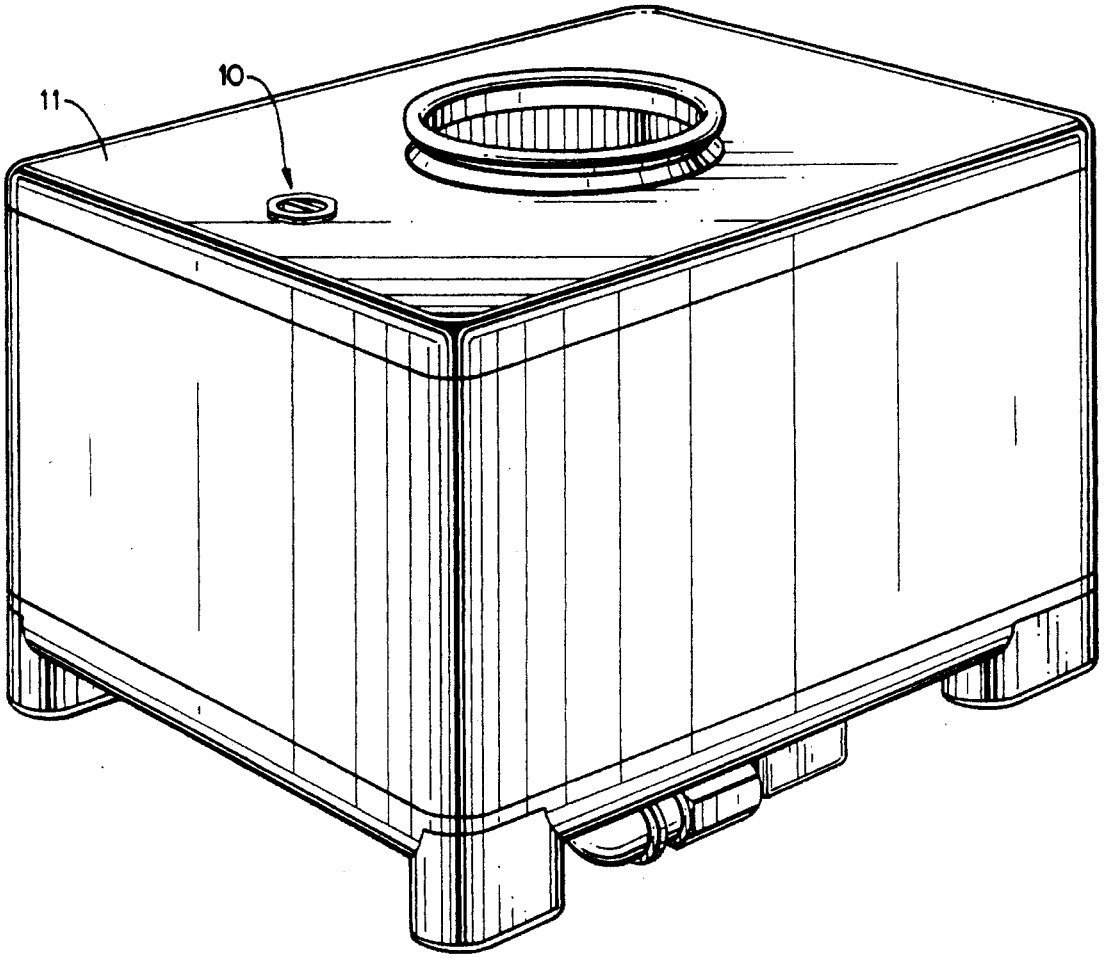
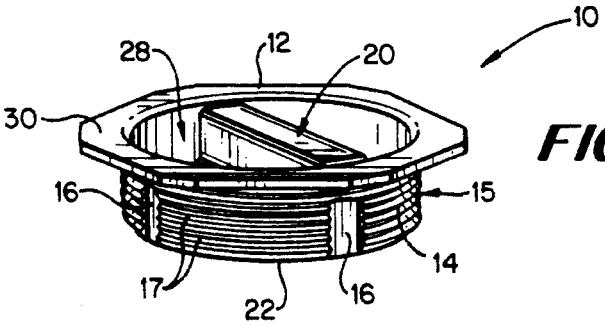
FIG. 2

VENTING DEVICE

BACKGROUND AND SUMMARY OF THE INVENTION

The present invention relates to a venting device for use with containers. More particularly, the present invention relates to a bung plug venting device having a threaded slot configuration for use in relieving internal pressure prior to filling or discharge of a container, with venting to the atmosphere.

Previous venting devices for use with containers are described, for example, in the following U.S. Pat. Nos. 169,150 to Cornish; 354,859 to Gillette; 599,300 to Mohn; 2,468,340 to Mirassou; 2,816,681 to Taylor; 2,840,105 to Routledge; 3,184,091 to Hoffman; 3,343,710 to Wehle et al.; 3,760,977 to MacKinnon; 4,026,512 to Holt; and 4,441,622 to Von Holdt.

By the present invention, there is provided an improved venting device in which a bung plug seals a filling or discharge opening in a container, with the bung plug having a threaded slot configuration to relieve internal pressure and to allow controlled venting to the atmosphere without complete removal of the bung plug. In one embodiment, a plurality of slots are spaced at equal intervals around the circumference of the bung plug and the number and width of the slots will depend on the capacity of the container. The depth of the slots in general corresponds to the depth of the threads on the plug.

It is therefore one object of the present invention to provide an improved bung plug venting device which is capable of relieving a container of the air or other gas pressure within the container without having to be removed and while still providing a secure fit.

It is another object of the present invention to provide a bung plug venting device which is easy to clean and service.

It is yet another object of the present invention to provide an improved bung plug venting device which prevents a substantial amount of air pollutants from reaching material inside a container during the venting process.

It is a further object of the present invention to provide a bung plug venting device whose venting capacity may be varied by varying the number and width of the venting slots on the bung plug.

BRIEF DESCRIPTION OF THE DRAWINGS

FIG. 1 is a perspective view showing a bung plug venting device as installed in a container in accordance with the present invention.

FIG. 2 is a perspective view showing the bung plug venting device of the present invention.

DESCRIPTION OF THE PREFERRED EMBODIMENTS

Figure 3:
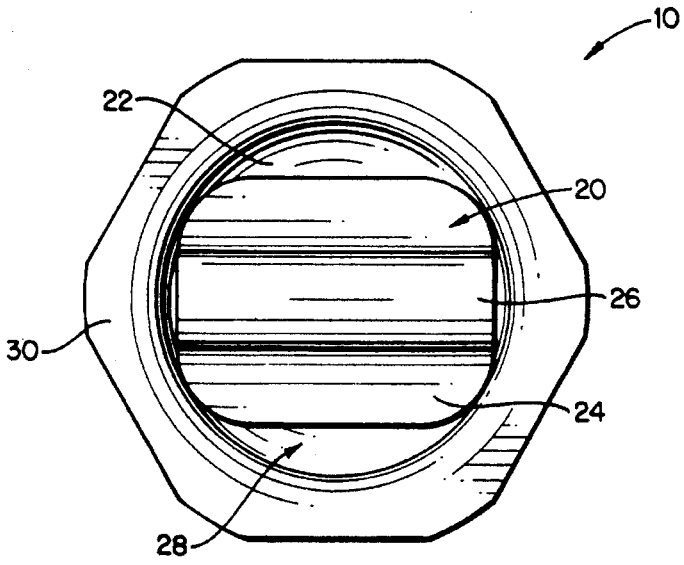
FIG. 3 is a plan view of the venting device of FIG. 2.
Figure 4:
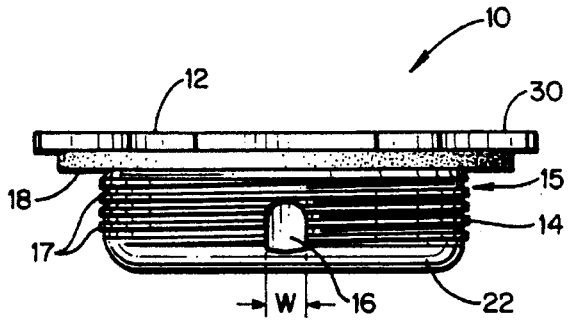
FIG. 4 is a side elevation of the venting device of FIG. 2.
Figure 5:
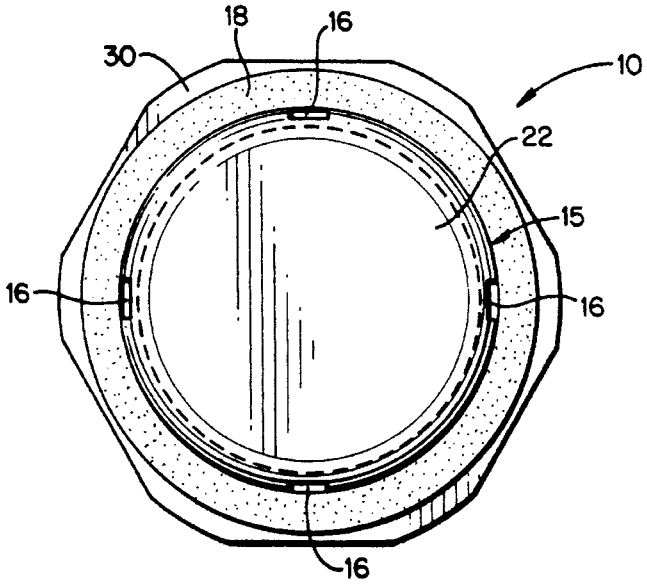
FIG. 5 is a bottom view of the venting device of FIG. 2.

In the embodiment of the present invention as shown in FIGS. 1 through 5, there is provided a bung plug venting device 10, constructed of stainless steel or other similar material, threadably mounted in the top wall of a container 11. As shown in FIG. 2, the device 10 includes a head portion 12 and a threaded neck portion 14. Located at equally spaced intervals around the circumference of the threaded neck portion 14 are a plurality of milled slots 16. The depth of the slots 16 generally corresponds to the thickness of the threads 17 on the threaded neck portion 14. In one embodiment, as shown in FIGS. 4 and 5, a sealing gasket 18 fits around the upper end of the threaded neck portion 14 and abuts the head portion 12. The head portion 12 includes an outer rim 30 which surrounds a recessed central area 28 and located within the recessed area 28 is a crossbar handle member 20 for screwing and unscrewing the bung plug 10. In one embodiment of the invention, as shown in FIG. 3, the handle member 20 is in the form of a stamped plate 24 having a raised bar portion 26 centrally located on the plate 24, with the plate 24 being welded or otherwise secured to the bottom wall 22 of the neck portion 14 of the device 10.

The slots 16 are milled into the radially outer surfaces 15 of the threaded neck portion 14. In one embodiment, the slots 16 extend from approximately two threads down from the upper end on the threaded portion 14 downwardly to intersect the curved sides of the bottom wall 22 of the neck portion 14. This configuration provides sufficient threads for sealing and, when the plug is unthreaded approximately two threads, the internal pressure is then relieved at a predetermined rate based on the width "w" and the number of slots 16. This permits the bung plug 10 to be ventilated at varying rates. The number of slots 16 as well as the width of the slots 16 is determined by the capacity of the container 11.

In one embodiment of the invention, the threaded neck portion 14 of the device 10 had a diameter of approximately 2 inches and the gasket 18 was of a polyseal material having an inner diameter of approximately 2 inches. In this embodiment, the height of the device 10 was approximately 13/16 inch and the height of the top of the slots 16 from the bottom wall 22 of the neck portion 14 was approximately 7/16 inch.

In use, when the bung plug 10 is screwed in tightly in the position as shown in FIG. 1, there is a complete seal on the container 11. The gasket 18 seals any possible leakage along the threaded neck portion 14. As the crossbar handle member 20 is turned so as to unscrew the bung plug 10 for ventilation, the bung plug 10 maintains a complete seal on the container 11 up until the moment when the two upper threads in the threaded neck portion 14 rise above the upper surface of the container 11, at which point the presence of the milled slots 16 causes the contents of the container 11 to be ventilated or de-pressurized, depending on the pressure conditions of the contents of the container 11. The bung plug 10 may then be returned to its secure seal on the container 11 by turning the crossbar handle member 20, thus having relieved the container 11 of pressure and having ventilated the contents of the container 11 without having removed the bung plug 10 itself.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A bung plug venting device for a container, comprising:

a head portion; and a threaded neck portion extending from said head portion for engagement with an opening in said container;

said threaded neck portion having a recessed interior defined by an outer circumferential wall portion and including at least one slot located in the outer circumferential wall portion of said threaded neck portion, the depth of said at least one slot corresponding to the thickness of the threads on the threaded neck portion, said at least one slot extending from below the upper threads of said threaded neck portion axially downwardly to a position adjacent a bottom wall of said threaded neck portion and being separated from said recessed interior by said outer circumferential wall portion, whereby, upon rotation of said bung plug toward the open condition, said bung plug may then relieve internal pressure within said container by allowing transfer of air or other gas to take place through said at least one slot without complete removal of said bung plug from said container.

2. The venting device of claim 1 wherein a sealing gasket fits around the upper end of said threaded neck portion so as to abut the head portion of said device.

3. The venting device of claim 1 wherein the outer circumferential portion of said threaded neck portion includes a plurality of slots.

4. The venting device of claim 3 wherein said plurality of slots are equally spaced at intervals around the circumference of said threaded neck portion.

5. The venting device of claim 1 wherein said at least one slot extends from approximately two threads down from the exposed upper end of said threaded neck portion downwardly to intersect curved sides of a bottom wall of said threaded neck portion.

6. The venting device of claim 1 wherein said head portion includes an outer recessed portion, said recessed portion having a crossbar handle member for opening and closing said bung plug.

7. The venting device of claim 6 wherein said handle member is in the form of a stamped plate having a raised bar portion.

8. A bung plug venting device for a container, comprising:

a head portion of a generally planar shape for engaging the walls of an opening in said container; and a threaded neck portion extending from said head portion for engagement with said opening;

said threaded neck portion having upper and lower ends and with at least one slot located in the outer circumferential portion of said threaded neck portion, wherein the depth of said at least one slot corresponds to the thickness of the threads on the threaded neck portion, said at least one slot having an upper end located below the upper threads of said threaded neck portion and with said at least one slot extending along said outer circumferential portion to a position adjacent said lower end of said threaded neck portion, whereby, upon rotation of said bung plug toward the open condition, said bung plug may then relieve internal pressure within said container by allowing transfer of air or other gas to take place through said at least one slot without complete removal of said bung plug from said container.

9. The venting device of claim 8 wherein the width of said at least one slot is selected based upon the capacity of said container.

10. The venting device of claim 8 wherein said at least one slot extends axially along said outer circumferential portion of said threaded neck portion.

* * * * *